428-919 SR
8/25/81 XR 4,285,068

United States Patent [19]
Ross

[11] 4,285,068
[45] Aug. 25, 1981

[54] CAMOUFLAGE HEADWEAR

[76] Inventor: Daniel L. Ross, 3370 Highway A, Festus, Mo. 63028

[21] Appl. No.: 127,975

[22] Filed: Mar. 6, 1980

[51] Int. Cl.³ ..... A42B 1/04
[52] U.S. Cl. ..... 2/202; 2/206; 428/919
[58] Field of Search ..... 2/202, 205, 206, 13; 428/919

[56] References Cited

U.S. PATENT DOCUMENTS

| | | | |
|---|---|---|---|
| 772,273 | 10/1904 | Braverman | 2/206 |
| 1,186,703 | 6/1916 | Sullivan | 2/202 |
| 3,397,026 | 8/1968 | Spina | 2/13 X |
| 3,740,767 | 6/1973 | Schuessler | 2/206 X |
| 3,823,418 | 7/1974 | Piper | 2/206 |

*Primary Examiner*—Peter P. Nerbun
*Attorney, Agent, or Firm*—Grace J. Fishel

[57] ABSTRACT

Camouflage headwear for use while hunting wild game or for use while observing or photographing them is described, said headwear camouflaging the wearer's face and neck and breaking up the wearer's silhouette. More particularly, said headwear includes a mask having a pair of eyeholes and a band for encircling the wearer's head and attaching said mask thereto and for holding the eyeholes in said mask in registry with the wearer's eyes, said mask being a plate, preshaped to conform to the wearer's face and leaving the lower part thereof free, a bag with a rounded bottom formed of netting having patches of preselected colors and having a pair of eyeholes, said bag adapted to fit loosely over the wearer's head and drape down over his neck, and means for attaching said mask on the inside of said bag such that the eyeholes in the mask are aligned with the eyeholes in the bag.

5 Claims, 5 Drawing Figures

CAMOUFLAGE HEADWEAR

This invention relates to camouflage headwear for use while hunting deer, turkeys, ducks and other wild game or for use while observing or photographing them.

To come within close range of game, it has been found desirable to wear some form of camouflage over the face and neck. In addition to camouflaging the face and neck, it would also be desirable if the headwear would break up the wearer's silhouette since movement of a sharply defined image is likely to spook the game. Finally, in addition to camouflaging the face and neck portions and breaking up the wearer's silhouette, it would also be desirable if the headwear did not rustle, was cool to wear yet provided some windbreak and served as a screen for insects, while at the same time, not interfering with the wearer's vision for operating a gun, bow, camara or the like.

In view of the above, among the several objects of the present invention may be noted the provision of headwear which camouflages the wearer's face and neck portions and which breaks up his silhouette but which does not interfere with his vision. Other objects and features will be in part apparent and in part pointed out hereinafter.

The invention accordingly comprises the constructions hereinafter described, the scope of the invention being indicated in the subjoined claims.

In the drawings, in which several of various possible embodiments of the invention are illustrated corresponding reference numerals refer to corresponding parts throughout the drawings and in which, FIG. 1 is a perspective view showing camouflage headwear in accordance with the present invention in use on a maniken;

Figure 1:
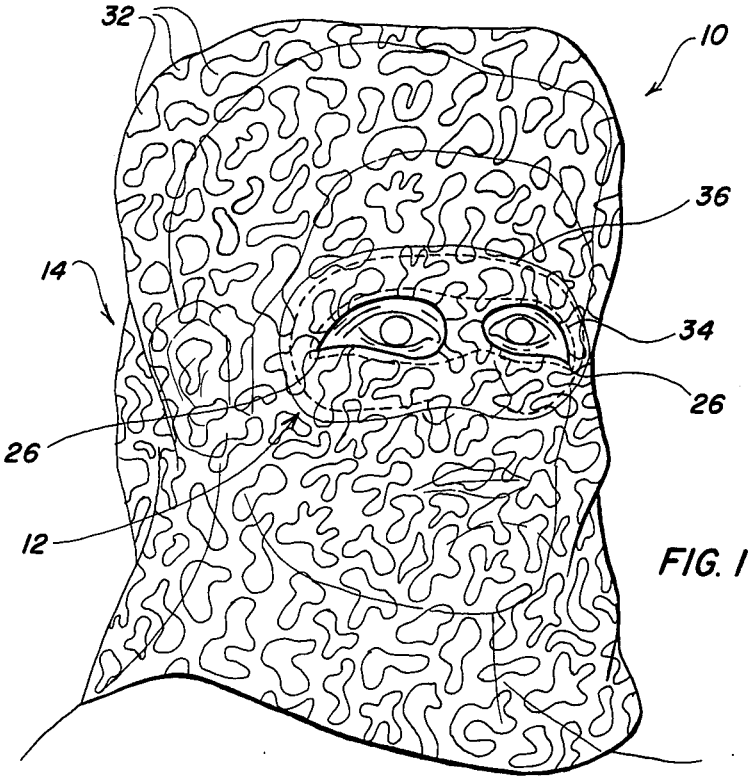

Referring to the drawings more particularly by reference character, reference numeral 10 refers to camouflage headwear in accordance with the present invention. As shown headwear 10 includes a mask 12 which supports a bag 14 for completely covering the head and neck of the wearer, leaving only the wearer's eyes uncovered.

As shown in the drawings, mask 12 is formed from an oval plate which is preshaped to conform to the wearer's face and having nose 16 and eyehole portions 18. Since mask 12 must be somewhat stiff to provide a support and point of attachement for bag 14, the wearer tends to perspire under the mask. To minimize discomfort and still give support to bag 14 so that it will not twist and osbtruct the wearer's vision, mask 12 is made as small as possible. For this reason, mask 12 is preferably of the masquerade or Lone Ranger type with the lower edge terminating over the bridge of the wearer's nose and leaving the lower part of his face and cheeks free.

A band 20, preferably formed of elastic, is attached at opposite side edges of mask 12 for encircling the wearer's head and attaching said mask thereto in such a way that the eyeholes of the mask are held in registry with the wearer's eyes. As illustrated in the drawings, the ends of band 20 pass through holes in the sides of the mask but not through bag 14 and are attached to clips 22 on the face thereof which when pulled against assume a position wherein they will not pass back through the holes.

Figure 5:
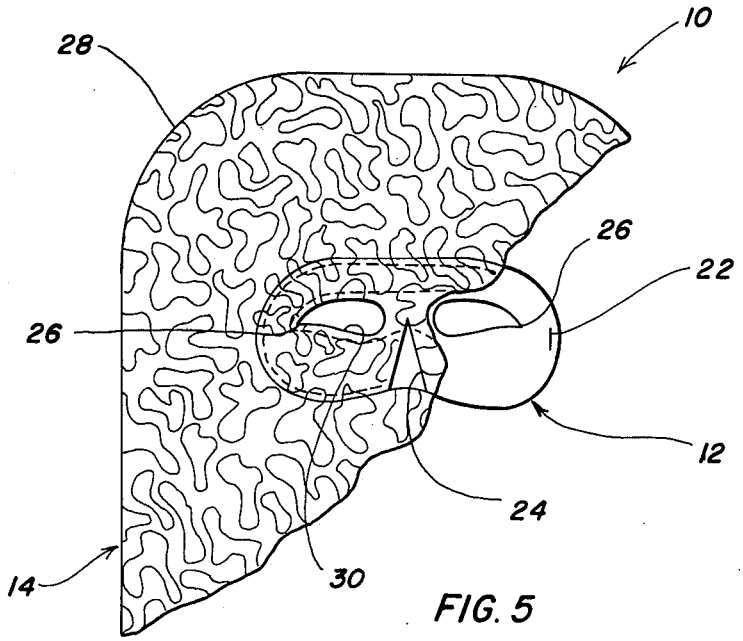
FIG. 5 is a front view like FIG. 2 but with part of the netting of the bag torn away and illustrating an embodiment of the headwear which is specially adapted for archery.

Referring to the drawings, it is seen that mask 12 allows the user to rest the stock of a gun or the like against his cheek in a conventional manner through bag 14 as more particularly described below. If headwear 10 is to be used for archery, as shown in FIG. 5, a notch 24 can be cut in nose 16 such that the archer may touch the bowstring to the tip of his nose or the center of his upper lip through the fabric of bag 14. While not all archers have this habit, some use this technique for sighting the arrow and for them the embodiment shown in FIG. 5 is preferred.

With continuing reference to the drawings, it is seen that eyeholes 18 are teardrop shaped, tapering towards a point 26 at the outside of each eyehole. By tapering eyeholes 18, the area is minimized which is left uncamouflaged around the wearer's eye.

Figure 2:
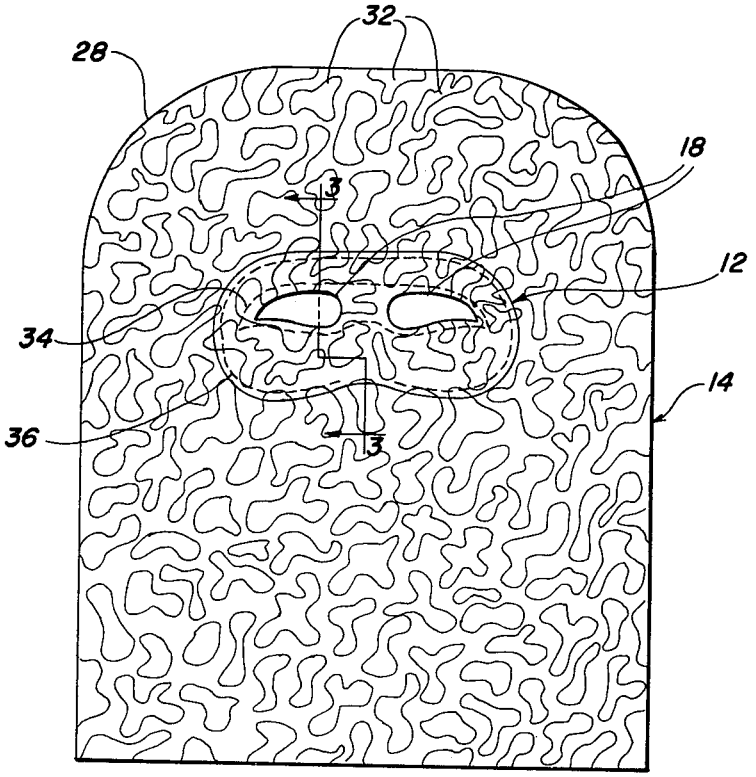
FIG. 2 is a front view of the camouflage headwear.
Figure 3:
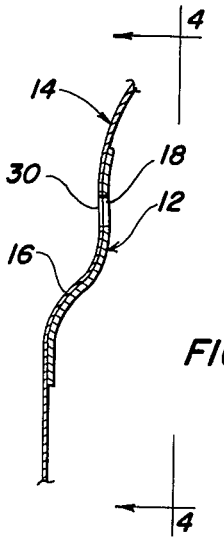
FIG. 3 is a sectional view taken along line 3—3 in FIG. 2.

Bag 14 is formed of netting, preferably cotton netting, which is cut into two sections of preselected shape such that when the sections are joined together they provide a bag with a rounded bottom 28. It is considered important that bag 14, when viewed as in FIG. 2, have a rounded bottom, thus avoiding excess material bunching at the top of the wearer's head and forming a dark shadow. Bag 14, like mask 12, is also provided with eyeholes 30 of a size and shape like eyeholes 18. The netting forming bag 14 is dyed or otherwise made with patches 32 of different shades or colors, preferably various shades of green and/or browns so as to blend in with the natural surroundings.

Bag 14 is sized so that it will completely but loosely cover the wearer's head and drape down over his neck. If the wearer wears a small hat, bag 14 will not drape down as far but in any case, bag 14 preferably drapes down far enough to comouflage an open shirt collar exposing skin or a white T-shirt.

Figure 4:
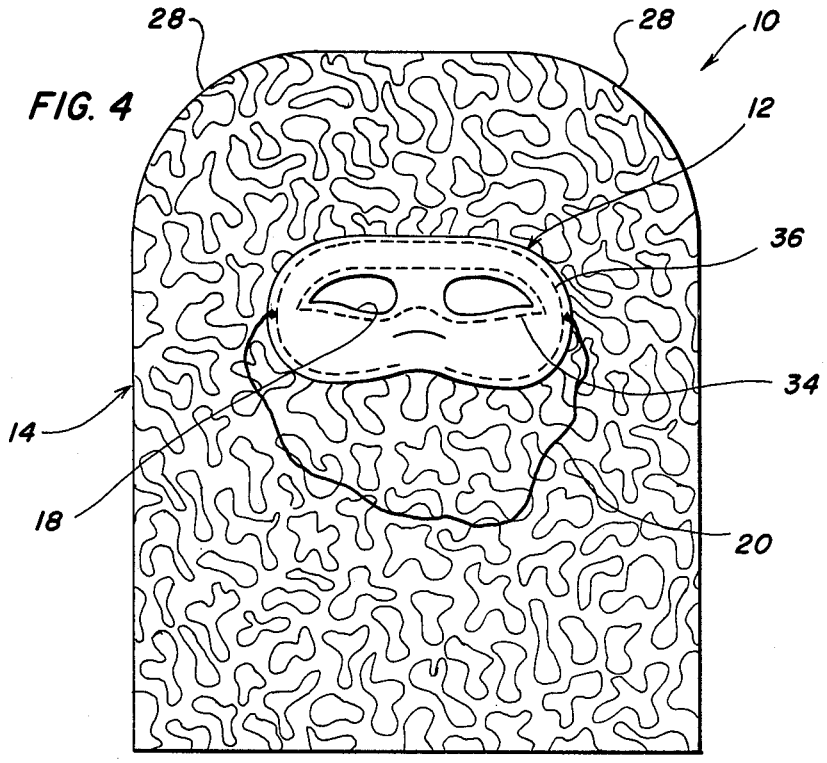
FIG. 4 is a sectional view taken along line 4—4 in FIG. 3.

As best seen in FIG. 4, mask 12 is attached to the inside of bag 14 by attachment means such that the eyeholes in the mask are aligned with the eyeholes in the bag. Suitable means for attaching the mask to bag 14 are two spaced apart lines of stitching 34 and 36, the first line formed around the periphery of the aligned eyeholes 18 and 30 and the second formed around the periphery of the mask but not crossing nose 16. By terminating stitching 36 over the mask nose, the netting of bag 14 is seen to drape more freely around the wearer's nose.

In use, camouflage headwear 10 does not interfere with the wearer's vision, particularly his peripheral vision, and exposes little skin around the eye. The netting and patches 32 of bag 14 camouflage the wearer's face and neck and break up his silhouette. The netting serves as a light windbreaker but is cool and when made of cotton does not rustle when the wearer moves his head. It also serves as a screen for insects.

In view of the above, it will be seen that the several objects of the invention are achieved and other advantageous results attained. As various changes could be made in the above constructions without departing from the scope of the invention, it is intended that all matter contained in the above description shall be interpreted as illustrative and not in a limiting sense.

What is claimed is:

1. Camouflage headwear for use while hunting wild game or for use while observing or photographing them, said headwear comprising a mask having a pair of eyeholes and a band for encircling the wearer's head and attaching said mask thereto and for holding the eyeholes in said mask in registry with the wearer's eyes, said eyeholes leaving only the wearer's eyes uncovered whereby the area around the wearer's eyes which is left uncamouflaged is minimized so that game is less likely to perceive the wearer, said mask being a plate preshaped to conform to the wearer's face and fit snugly against his face so that said eyeholes do not interfere with the wearer's peripheral vision, a bag with a rounded bottom formed of netting having patches of preselected colors and having a pair of eyeholes, said bag adapted to fit loosely over the wearer's head and drape down over his neck, and means for attaching said mask on the inside of said bag such that the eyeholes in the mask are aligned with the eyeholes in the bag.

2. The headwear of claim 1 wherein the eyeholes in the mask and in the bag are teardrop shaped, tapering towards a point at the outside of each eyehole.

3. The headwear of claim 2 wherein the mask partially covers the wearer's face leaving the lower part of his face free.

4. The headwear of claim 3 wherein the means for attaching the mask is stitching which is formed in two spaced apart lines, the first line formed around the periphery of said aligned eyeholes and the second formed around the periphery of mask except over the nose portion of said mask.

5. The headwear of claim 4 wherein the band encircling the wearer's head is an elastic band, said elastic band passing through holes in the sides of the mask but not through said bag, the ends of the elastic band being attached to metal clips which in at least one position will not pass through the holes in the sides of the mask.

* * * * *